United States Patent [19]

Dainty, Jr.

[11] 4,251,890

[45] Feb. 24, 1981

[54] BABY CRADLE

[76] Inventor: Robert J. Dainty, Jr., 5347 E. 23rd St., Tulsa, Okla. 74114

[21] Appl. No.: 48,688

[22] Filed: Jun. 14, 1979

[51] Int. Cl.[3] ..... A47D 9/00

[52] U.S. Cl. ..... 5/103; 5/108; D6/15

[58] Field of Search ..... 5/101-109, 5/11-13; D6/15, 153, 154

[56] References Cited

U.S. PATENT DOCUMENTS

| | | | |
|---|---|---|---|
| 1,363,453 | 12/1920 | Brown | 5/103 |
| 1,540,540 | 6/1925 | Camm et al. | 5/103 |
| 2,071,016 | 2/1937 | Archer | 5/103 |
| 3,061,373 | 10/1962 | Sarchia | 297/452 |
| 3,078,479 | 2/1963 | Grosse | 5/104 |

*Primary Examiner*—Casmir A. Nunberg
*Attorney, Agent, or Firm*—Head & Johnson

[57] ABSTRACT

A baby cradle constructed from a barrel and having the opposite ends thereof supported from a frame by a pivot connection whereby the relatively great weight of the barrel produces an extended time period for rocking of the cradle between manual initiation of the rocking motion.

6 Claims, 5 Drawing Figures

BABY CRADLE

BACKGROUND OF THE INVENTION

1. Field of the Invention

This invention relates to improvements in cradles and more particularly, but not by way of limitation, to a baby cradle suspended in a manner for prolonged rocking action.

2. Description of the Prior Art

Cradles for infants have been available for many, many years, and since it is considered advantageous to provide a rocking motion for the cradle, many of the cradles are supported by rocker elements which can be utilized for rocking the cradle to and fro. Of course, the rocking motion usually extends through a relatively short time period and must be manually or otherwise renewed frequently in order to achieve any lasting effects for the infant disposed in the cradle. In order to overcome the disadvantage of the short time periods for the usual rocker elements, many cradles have been developed with particular devices included thereon for increasing the overall time period of the rocking motion without the necessity of reactivating the rocking device. Counterweights, such as shown in the J. J. Waldheim et al U.S. Pat. No. 3,255,465, issued June 14, 1966, and entitled "Baby Basket Stand and Rocking Device"; a swinging type cradle mounting as shown in the James R. Meade U.S. Pat. No. 3,761,969, issued Oct. 2, 1973, and entitled "Article of Furniture; and other relatively complicated structures have been devised to improving the motion of cradles, but these have been relatively inefficient and most have been expensive and complicated to construct. In addition, it is considered an advantage to provide an attractive overall aspect for the cradle, and most of the cradles in widespread use today are of a generally similar appearance in that most of the cradles look similar to a basket or the usual baby bed.

SUMMARY OF THE INVENTION

The present invention contemplates a novel cradle for infants which is particularly designed and constructed for overcoming the foregoing disadvantages. The novel cradle is of a particularly unique and attractive overall appearance in that it is constructed from a wooden barrel, keg, or the like, which is suspended above the floor between a pair of upright supports. The upper portion of the barrel or keg is cut-away through approximately one half thereof to provide open access to the interior thereof, and the interior is lined with a suitable cushion or soft material pleasingly comfortable for the infant resting therein. The size of the barrel is preferably such that the mattress for the cradle may be the usual king-size pillow, which greatly facilitates the changing of the sheets in that the sheet may be the usual king-size pillow case. The opposite ends of the barrel or keg are pivotally suspended to the respective upright support for free rotation about a substantially horizontally disposed axis, and the relatively great weight of the keg or barrel causes the cradle to rock gently through a prolonged period of time subsequent to initiation of the rocking process. For example, the cradle has been found to move gently to and from for a time subsequent to initiation of the rocking process. For example, the cradle has been found to move gently to and from for a time period of approximately one hour without the necessity of reactivating the rocking action. The cradle is of a uniquiely attractive appearance, and functions in an efficient manner. In addition, the structure is economical and simple.

DESCRIPTION OF THE PREFERRED EMBODIMENT

Figure 2:
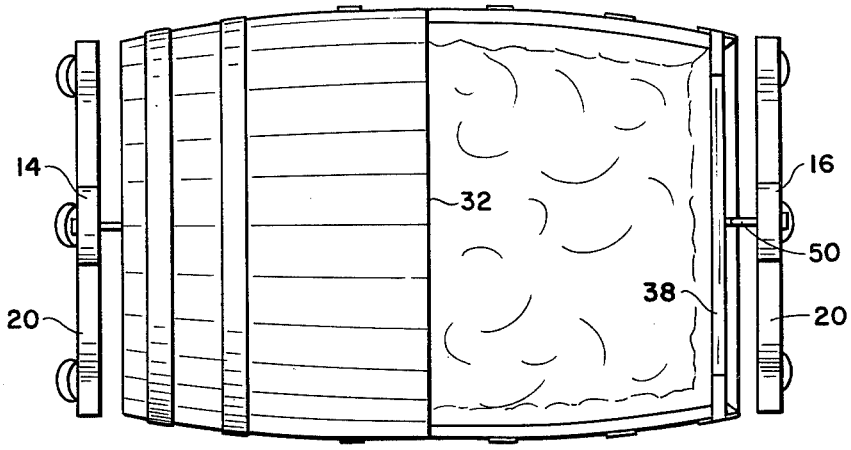
FIG. 2 is a top view of a cradle embodying the invention.

Referring to the drawings in detail, reference character 10 generally indicates an infant's cradle comprising a barrel or keg 12 suspended between a pair of upright support legs 14 and 16 spaced apart by a slat member 18. The support legs 14 and 16 are substantially identical and are each provided with standard member 20 at the lower end thereof for supporting the legs from the floor (not shown). The standard member 20 may be of any suitable configuration, and as soon herein comprises an arcuate strap member 22 having suitable caster members 24 and 26, or the like, secured to the opposite ends thereof in any well known manner for facilitating transporting of the cradle across the surface of the floor. A substantially centrally disposed downwardly extending prop member 28 is interposed between the outer ends of the strap 22 and a third caster member 30 is secured thereto in any well known manner for cooperation with the casters 24 and 26 for supporting the respective support legs 14 and 16.

Figure 1:
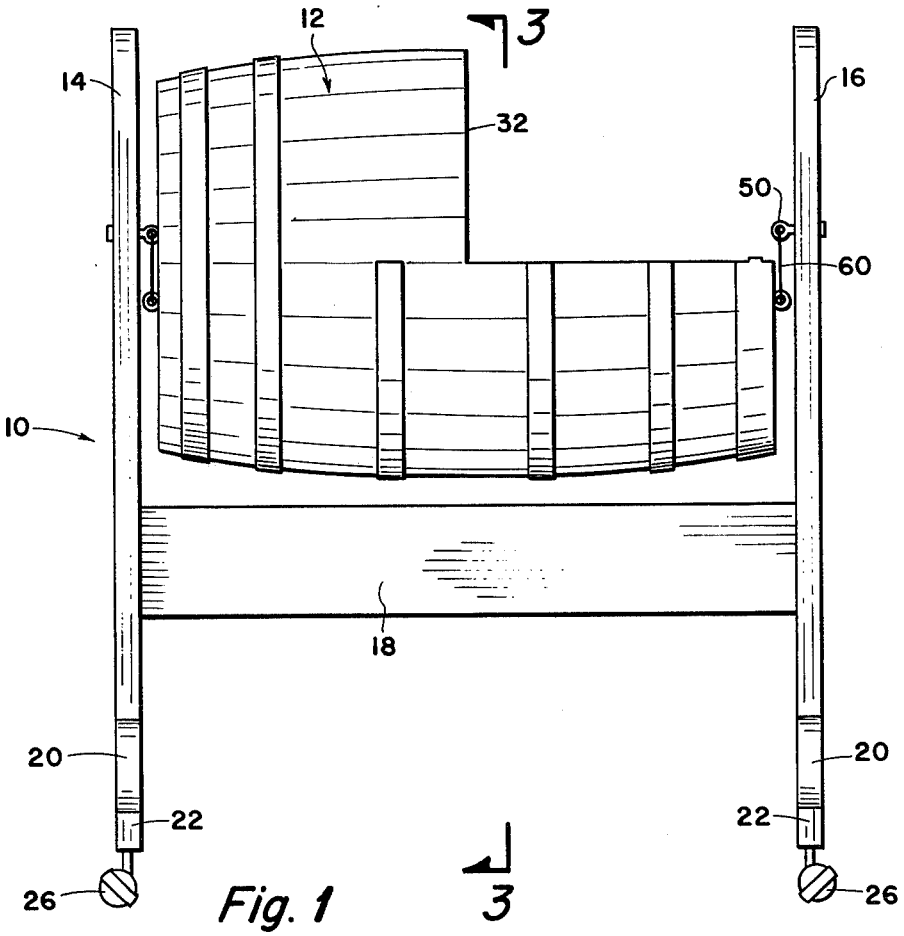
FIG. 1 is a side elevational view of a cradle embodying the invention.
Figure 3:
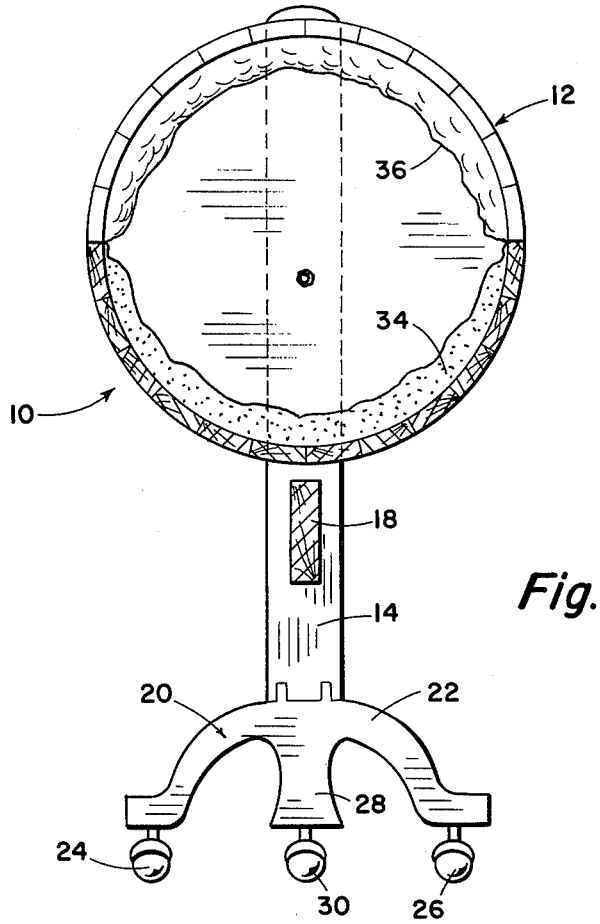
FIG. 3 is a sectional view taken on line 3—3 of FIG. 1.

The barrel or keg is preferably constructed of wood and substantially one-quart of the barrel or keg 12 is cut-away at the upper portion thereof, as particularly shown at 32 in FIG. 1 to provide an open access to the interior of the barrel. It is preferable to line the entire inner periphery of the barrel 12 with a suitable material, such as a soft padding or foam material as indicated at 34 in FIG. 3. Of course, the padding or foam material 34 is preferably covered with a suitable fabric as shown at 36, which enhances the overall appearance of the cradle 10 and protects the infant (not shown) from the padding material 34. A suitable mattress (not shown) may be disposed within the barrel or keg 12 for receiving the infant thereon, and it has been found that the usual internal dimensions of a barrel or keg suitable for this purpose are such that the usual king-size pillow functions well as a mattress. Since the pillow may be encased in the usual king-size pillow case (not shown), the changing of the "sheets" in the cradle 10 is greatly facilitated.

Figure 4:
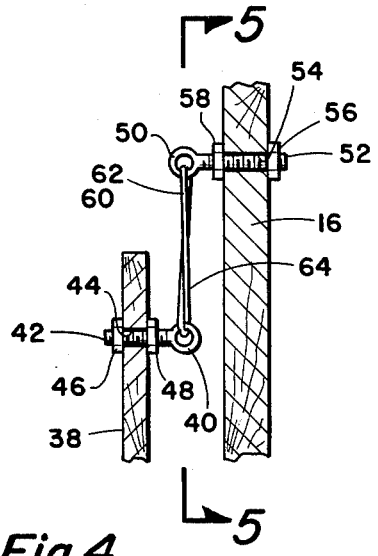
FIG. 4 is an enlarged sectional view of a portion of one support let for illustration of a pivot connection utilized in a cradle embodying the invention.
Figure 5:
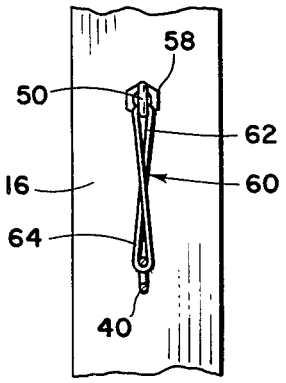
FIG. 5 is a sectional view taken on line 5—5 of FIG. 4.

The opposite ends of the barrel or keg 12 are suspended from the respective support 14 and 16 in such a manner that the barrel 12 may easily be rotated or swung about a substantially horizontally disposed axis. The ends of the barrel 12 are substantially flat circular discs, a portion of one end being shown at 38 in FIG. 4, and a suitable eye member 40 is secured to each end of the barrel in any well known manner, such as by a threaded shank 42 extending through a bore 44 and having suitable lock nuts 46 and 48 secured against the opposite faces of the respective barrel end 38. The bore 44 is preferably positioned on a diameter of the end 38, and spaced radially outwardly from the center of the disc whereby a preponderance of the weight of the barrel 12 will be suspended below the axis determined by the studs 42 of each end 38. A second eye member 50, generally similar to the eye 40, is secured to the respective sport leg, such as the leg 16, in any well known manner, and is spaced above the eye 40 as particularly shown in FIGS. 4 and 5. The eye 50 is disposed inwardly of the leg 16 and may be secured to the leg 16 by a threaded shank member 52 extending through a bore 54, and having cooperating lock nuts 56 and 58 disposed against the opposite sides of the leg 16. A continuous loop member 60 extends between the spaced eyes 40 and 50, and is preferably twisted in such a manner as to provide an upper loop 62 and a lower loop 64. The upper loop 62 is loosely disposed within the eye 50 and freely swings or pivots with respect thereto. The lower loop 64 is loosely disposed within the eye 40 and the eye 40 freely swings or pivots with respect thereto. This double-pivot linkage connection provides a smooth and efficient swinging or to and fro action for the barrel suspended thereby and about collective axles provided by the eyes 40 and 50. It has been found that this unique connection means in combination with the relatively heavy weight of the barrel 12, a preponderance of the weight being supported below the linkage assembly, provides a relatively long time period of swinging action for the barrel 12 once it has been manually set into motion.

From the foregoing it will be apparent that the present invention provides a novel infant's or baby's cradle which is of a unique overall appearance coupled with an improved pivot linkage for suspending the cradle in a manner for a smooth and gentle, long lasting rocking action for the baby resting in the cradle. The novel cradle is simple and efficient in operation and economical and durable in construction.

Whereas the present invention has been described in particular relation to the drawings attached hereto, it should be understood that other and further modifications, apart from those shown or suggested herein may be made within the spirit and scope of this invention.

What is claimed is:

1. A cradle comprising a barrel suspended between a pair of upright support members and disposed in a substantially horizontal position, said barrel having a cutaway portion providing access to the interior thereof, and connection means secured between each support member and the barrel for suspending the barrel for pivotal movement about a substantially horizontal axis, said connection means being secured to the opposite ends of the barrel at a point spaced below the longitudinal axis of the barrel for facilitating a rocking motion for the cradle.

2. A cradle as set forth in claim 1 wherein the cutaway portion comprises substantially one-quarter of the barrel removed from the upper portion thereof.

3. A cradle as set forth in claim 1 wherein substantially horizontally disposed strap means is secured between the upright support members for maintaining said spaced relation therebetween.

4. A cradle as set forth in claim 3 wherein each support member is provided with caster means for support thereof in a manner facilitating portability of the cradle.

5. A cradle as set forth in claim 1 wherein the connection means comprises first eye means secured to each of said support members and disposed in substantial horizontal alignment, second eye means secured to each end of the barrel at a point spaced below the longitudinal axis of the barrel and disposed in substantial axial alignment, and link means extending between the first eye means of each support respective second eye means of the barrel for suspending the barrel from said first eye means in order to provide for a rocking motion of the barrel about the axis determined collectively by the first and second eye means.

6. A cradle as set forth in claim 5 wherein the link means comprises an endless connecting member having upper and lower loops provided therein, said upper loop being loosely disposed through said first eye means and said lower loop member being loosely disposed through said second eye means to suspend said second eye means in spaced relation below said first eye means to provide said rocking motion.

* * * * *